United States Patent [19]

Newsome

[11] Patent Number: 4,586,605

[45] Date of Patent: May 6, 1986

[54] CIGARETTE PACK

[75] Inventor: Reginald W. Newsome, Richmond, Va.

[73] Assignee: Philip Morris Incorporated, New York, N.Y.

[21] Appl. No.: 742,710

[22] Filed: Jun. 7, 1985

[51] Int. Cl.[4] ..... B65D 85/10

[52] U.S. Cl. ..... 206/267; 206/270

[58] Field of Search ..... 206/267, 270, 265, 266, 206/268, 273; 229/44 CE, 10, 20

[56] References Cited

U.S. PATENT DOCUMENTS

| | | | |
|---|---|---|---|
| 409,029 | 8/1889 | Elliott | 206/270 |
| 2,894,619 | 7/1959 | Gallo | 206/48 |
| 2,947,413 | 8/1960 | Tuomala et al. | 206/41.1 |
| 2,950,060 | 8/1960 | Von Rudeen | 229/44 |
| 3,052,398 | 9/1962 | Benjamin | 229/20 |
| 3,058,646 | 10/1962 | Guyer | 229/44 |
| 3,102,675 | 9/1963 | Schrom | 229/20 |
| 3,165,249 | 1/1965 | Peck | 225/43 |
| 3,245,525 | 4/1966 | Shoemaker | 206/41.2 |
| 3,395,787 | 8/1968 | Plaskan | 206/270 |
| 3,645,382 | 2/1972 | Abrams | 206/45.21 |

FOREIGN PATENT DOCUMENTS

| | | | |
|---|---|---|---|
| 89565 | 5/1920 | Switzerland | 206/270 |
| 1335683 | 10/1973 | United Kingdom . | |
| 1448629 | 9/1976 | United Kingdom . | |

*Primary Examiner*—Joseph Man-Fu Moy

*Attorney, Agent, or Firm*—Jeffrey H. Ingerman

[57] ABSTRACT

A reclosable soft cigarette pack is provided. The pack has an inner foil sleeve telescopically received in an outer paper sleeve. A paperboard tab on the inner sleeve can be folded over the opening on the inner sleeve and positioned between the sleeves to reclose the pack.

11 Claims, 11 Drawing Figures

CIGARETTE PACK

BACKGROUND OF THE INVENTION

This invention relates to cigarette packs, and particularly to a resealable soft cigarette pack.

Cigarettes are typically sold in packs of twenty to twenty-five cigarettes. Two types of packs are in general use. The first type is the "soft pack," which is a bundle of cigarettes wrapped in foil, overwrapped with a paper wrapper which usually has brand and other information printed on its outer side, and overwrapped again with a sealed cellophane layer. The second type is the "box" or "FLIP-TOP® box," which is a hard paperboard box containing a foil-wrapped cigarette bundle and having a hinged lid at the top. Typically, a paperboard insert surrounds the bundle at least near the top of the box providing a frictional engagement surface to retain the lid in the closed position when desired. A cutout in this insert allows a smoker to remove cigarettes from the box.

Each type of pack has its own advantages and disadvantages. The soft pack has soft corners, and collapses as cigarettes are removed from it, taking up less space in a smoker's pocket or purse as the contents are smoked, while providing an approximate external indication of the number of cigarettes remaining in the pack. However, once the cellophane wrapper of a soft pack is opened, it cannot be resealed. As a result, any loose tobacco in the pack may eventually drop from the pack into the smoker's pocket or purse. The cigarettes can also be damaged if the pack is roughly handled. For these reasons, many smokers prefer the FLIP-TOP® box, which can be reclosed to prevent loose tobacco from dropping out, and which offers better protection for the cigarettes within it. However, the FLIP-TOP® box is not collapsible, has hard corners, and takes up the same amount of space in a pocket or purse regardless of the number of cigarettes remaining in it.

SUMMARY OF THE INVENTION

It is an object of this invention to provide a cigarette pack which will prevent the dropping out of loose tobacco.

It is another object of this invention to provide a cigarette pack having some of the advantages of both a soft pack and a FLIP-TOP® box.

It is a further object of this invention to provide a cigarette pack of increased attractiveness to smokers.

In accordance with the invention, a cigarette pack is provided having an inner sleeve member, an outer sleeve member, and a tab member. The inner sleeve member has a solid rectangular shape, and has a height substantially the length of a cigarette, a width approximately an integral multiple of the diameter of a cigarette, and a depth sufficient to accommodate a plurality of rows of cigarettes. The front and back walls of the inner sleeve member are each defined by the height and the width, the bottom wall is defined by the width and the depth, and the sides are defined by the height and the depth. The front wall has a cutout through which cigarettes may be withdrawn. The outer sleeve member has front, back and bottom walls and first and second side walls. The outer sleeve is telescoped about the inner sleeve and is capable of sliding with respect thereto. The height of the outer sleeve is less than that of the inner sleeve by an amount such that the inner sleeve protrudes sufficiently from the outer sleeve when fully retracted therein so that the inner sleeve can be grasped. The tab member has a top portion and a front portion. A portion of the tab member is adhered to a portion of the inner sleeve member and the front portion is positioned between the inner and outer sleeve members when the inner sleeve is fully retracted within the outer sleeve, such that the cigarette pack is closed.

Preferably, the inner sleeve is a foil-paper laminate, the outer sleeve is paper, the tab is paperboard, and a retainer member is provided to prevent the inner sleeve from being fully withdrawn from the outer sleeve.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout, and in which.

DETAILED DESCRIPTION OF THE INVENTION

Figure 1:
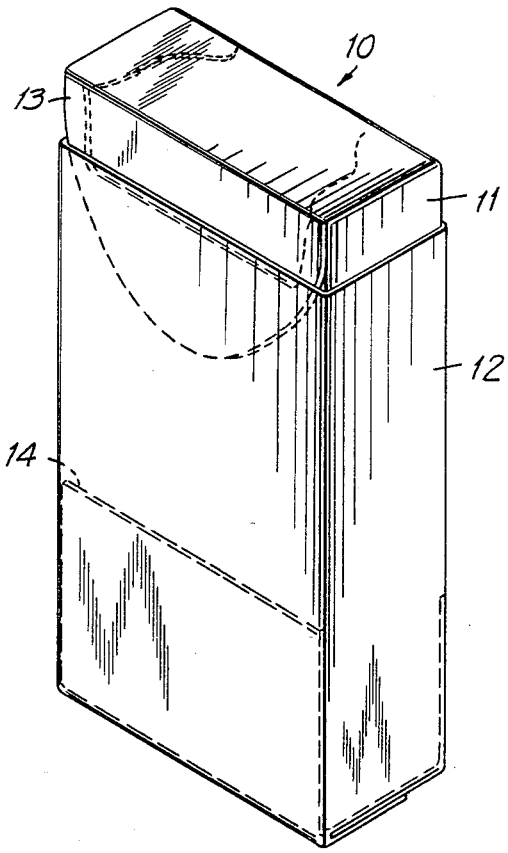
FIG. 1 is a front perspective view of a preferred embodiment of the cigarette pack of the invention in the closed position.

A preferred embodiment of the cigarette pack of the present invention is shown in FIGS. 1–4. Cigarette pack 10 includes an inner sleeve member 11, an outer sleeve member 12, a tab member 13, and a retainer member 14, and when closed is similar in size and shape to known soft cigarette packs.

Inner sleeve member 11 is similar to the inner foil layer of known soft packs, being folded from a foil-paper laminate sheet. Sleeve member 11 has a front wall 31, a back wall 40, a bottom wall 41, a first side wall 32, and a second side wall, not shown. Sleeve member 11 differs from the foil layers of known soft packs in that it is provided with cutout 34 for the removal of cigarettes.

Outer sleeve member 12 is similar to label layers of known soft packs, being folded from a paper sheet and usually having brand and other information and decoration printed thereon. Sleeve member 12 differs from the label layers of known soft packs in that it is sufficiently shorter than sleeve member 11 to allow sleeve member 11 to be grasped so that it can be slid out of sleeve member 12.

Figure 6:
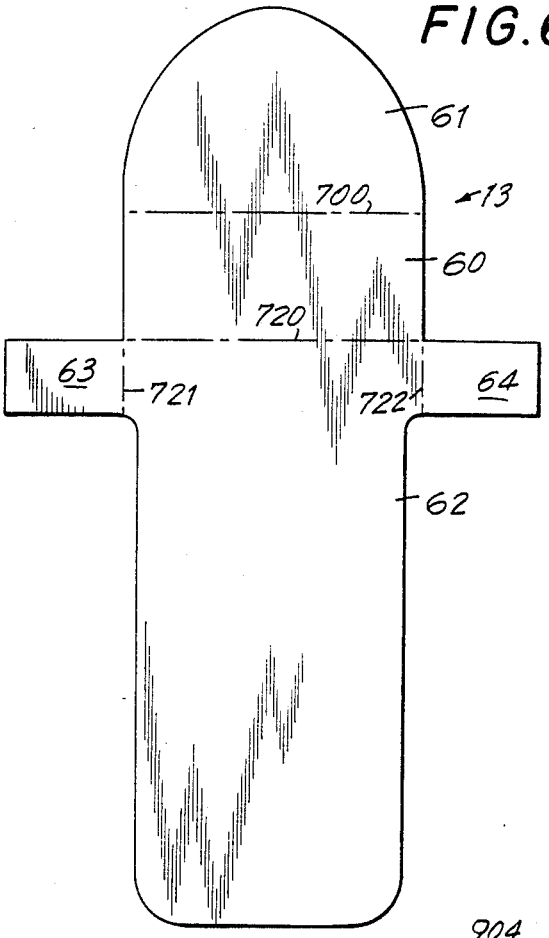
FIG. 6 is a plan view of a tab member for the cigarette pack of FIGS. 1–4.

Tab member 13 is preferably made of paperboard and a preferred shape thereof is shown in FIG. 6. Tab member 13 is divided by score lines 700, 720, 721, 722 into top portion 60, front portion 61, rear portion 62, and wings 63, 64. Rear portion 62 is adhered to the interior of back wall 40 of inner sleeve member 11, as best seen in FIG. 2.

When cigarette pack 10 is closed, tab member 13 is folded along score lines 700, 720 so that front portion 61 lies along front wall 31 of sleeve member 11, covering cutout 34. Front portion 61 is positioned between sleeve members 11 and 12, as best seen in FIG. 2. Wings 63, 64 lie along sides 31, 32, giving added protection to the cigarettes in pack 10 and stretching outer sleeve member 12 over front portion 61, holding it in place. In this way, cigarette pack 10 is closed against both the removal of cigarettes and the dropping out of loose tobacco. To open pack 10 for the removal of cigarettes, inner sleeve member 11 is slid out of outer sleeve member 12, allowing front portion 61 of tab member 13 to be raised, uncovering cutout 34. To reclose pack 10, tab member 13 is first folded over the top and along the front of sleeve member 11 so that front portion 61 covers cutout 34. Sleeve member 11 is then slid back into sleeve member 12.

Figure 2:
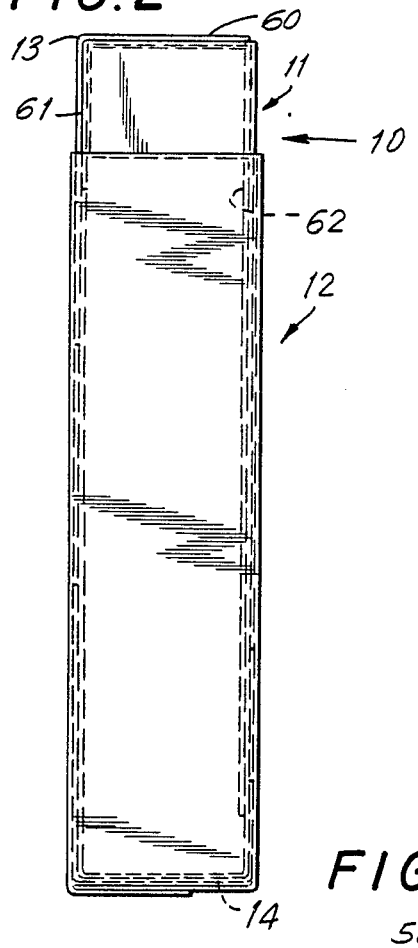
FIG. 2 is a side elevational view of the cigarette pack of FIG. 1 in the closed position.

As seen in FIGS. 2 and 6, rear portion 62 of tab member 13 is shorter than inner sleeve member 11, and narrower except where it abuts top portion 60. If rear portion 62 were of the same width and height as sleeve member 11, it would cause pack 10 to have hard, sharp corners, giving it the appearance and feel of a box. By making rear portion 62 shorter and narrower than sleeve member 11, the soft, rounded corners of a soft pack are preserved.

Figure 4:
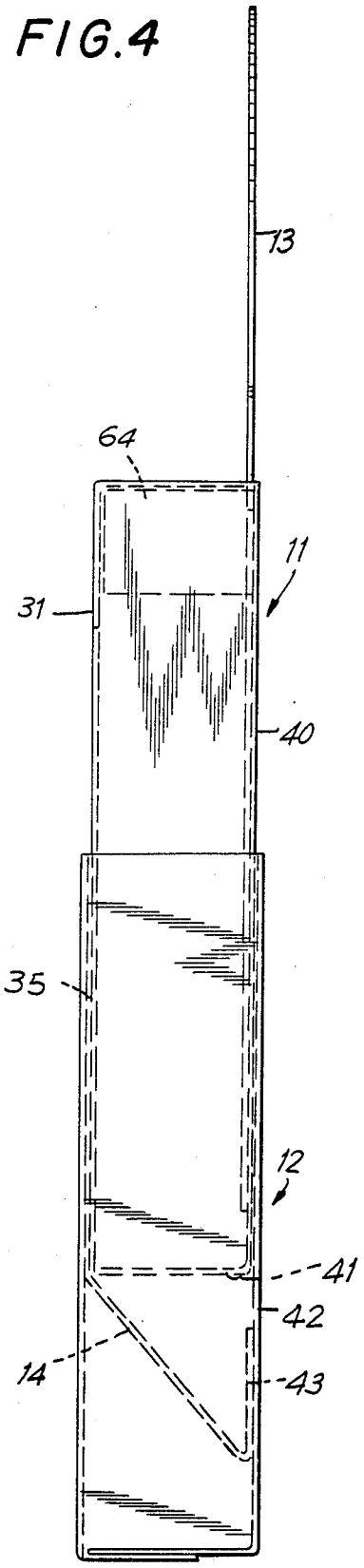
FIG. 4 is a side elevational view of the cigarette pack of FIGS. 1–3 in the open position.

If inner sleeve member 11 were removed completely from outer sleeve member 12, it would be difficult to re-insert for reclosing cigarette pack 10. Therefore retainer member 14, preferably in the form of a paper web, is preferably provided to prevent sleeve member 11 from being completely withdrawn from sleeve member 12. One end of retainer member 14 is adhered to the outside of front wall 31 of inner sleeve member 11 at 35. The other end of retainer member 14 is adhered to the inside of back wall 42 of outer sleeve member 12 at 43, thereby limiting the withdrawal of sleeve member 11 from sleeve member 12, as shown in FIG. 4.

Cigarette pack 10 thereby provides the reclosable feature of a FLIP-TOP ® box, preventing the dropping out of loose tobacco into a smoker's pocket or purse. At the same time, it provides the advantages of a soft pack, having soft corners, taking up less space in a pocket or purse as its contents are smoked, and providing an approximate visual indication at the number of cigarettes remaining within it.

Figure 5:
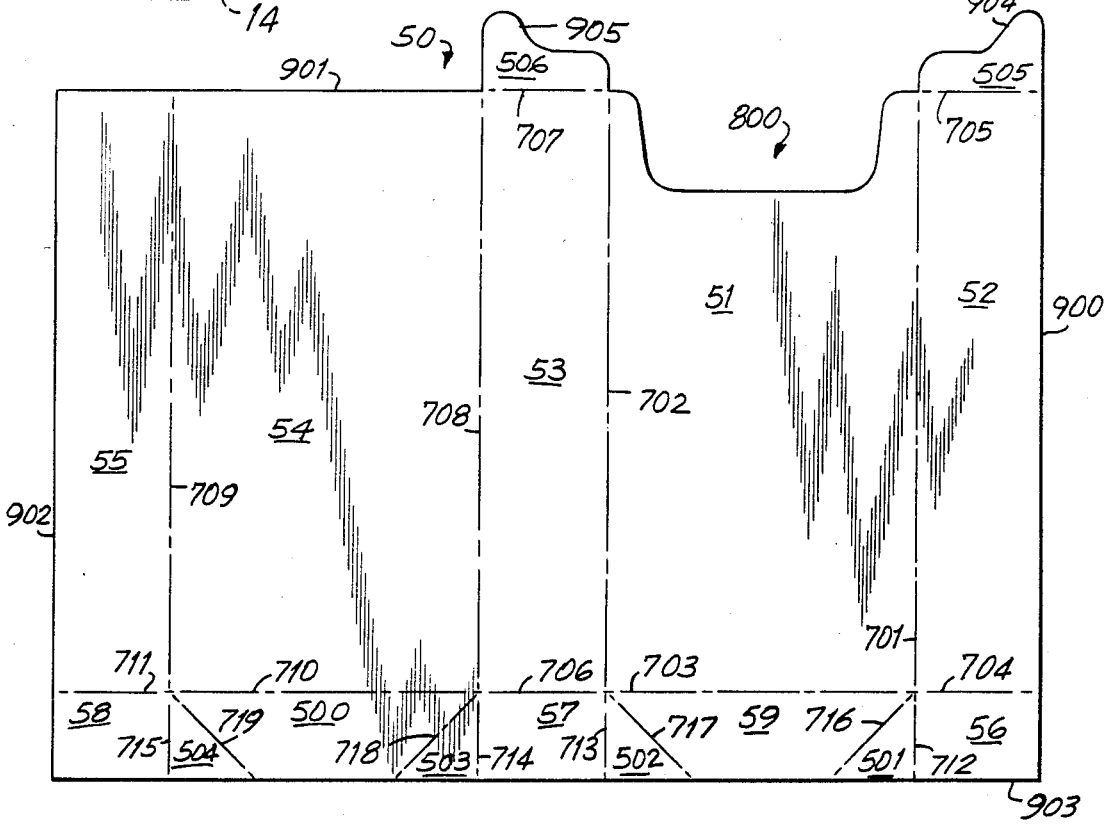
FIG. 5 is a plan view of an inner sleeve member blank for the cigarette pack of FIGS. 1–4.
Figure 3:
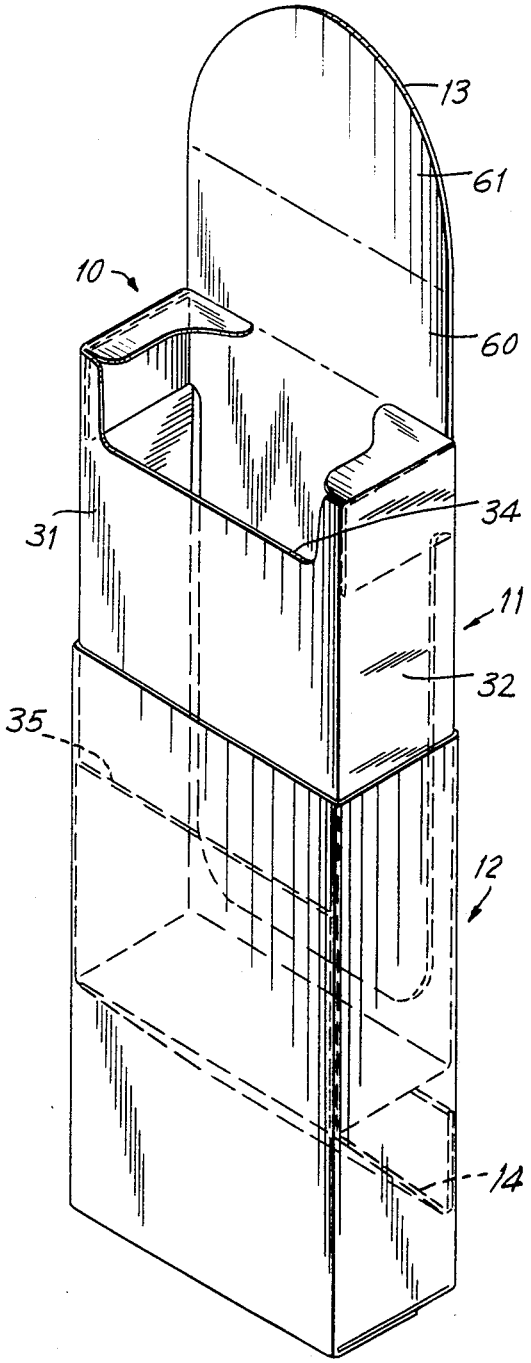
FIG. 3 is a front perspective view of the cigarette pack of FIGS. 1–2 in the open position.

A foil-paper laminate blank 50 from which inner sleeve member 11 is erected is shown in FIG. 5. Blank 50 has a front wall panel 51 defined by a pair of parallel long front-defining score lines 701, 702, a short front-defining score line 703 perpendicular to score lines 701, 702, and a cutout 800. First outer side panel 52 is defined by score line 701, parallel first outer side-defining score lines 704, 705 perpendicular to score line 701, and edge 900 of blank 50. Second outer side panel 53 is defined by score line 702, parallel second outer side-defining score lines 706, 707 perpendicular to score line 702, and first long back-defining score line 708. Back wall panel 54 is defined by score line 708, second long back-defining score line 709 parallel to score line 708, short back-defining score line 710 perpendicular to score lines 708, 709, and edge 901 of blank 50. Inner side panel 55 is defined by score line 709, inner side-defining score line 711 perpendicular to score line 709, and edges 901, 902 of blank 50. First outer closure tab 56 is defined by score line 704, first outer closure tab-defining score line 712 perpendicular to score line 704, and edges 900, 903 of blank 50. Second outer closure tab 57 is defined by score line 706, parallel second outer closure tab-defining score lines 713, 714 perpendicular to score line 706, and edge 903 of blank 50. Inner closure tab 58 is defined by score line 711, inner closure tab-defining score line 715 perpendicular to score line 711, and edges 902, 903 of blank 50. Outer bottom panel 59 is defined by score line 703, opposed diagonal outer bottom-defining score lines 716, 717, and edge 903 of blank 50. Inner bottom panel 500 is defined by score line 710, opposed diagonal inner bottom defining score lines 718, 719, and edge 903 of blank 50. First outer bottom folding panel 501 is defined by score lines 712, 716 and edge 903 of blank 50. Second outer bottom folding panel 502 is defined by score lines 713, 717 and edge 903 of blank 50. First inner bottom folding panel 503 is defined by score lines 714, 718 and edge 903 of blank 50. Second inner bottom folding panel 504 is defined by score lines 715, 719 and edge 903 of blank 50. First top closure tab 505 is defined by score line 705 and first curved edge 904 of blank 50. Second top closure tab 506 is defined by score line 707 and second curved edge 905 of blank 50.

Figure 9:
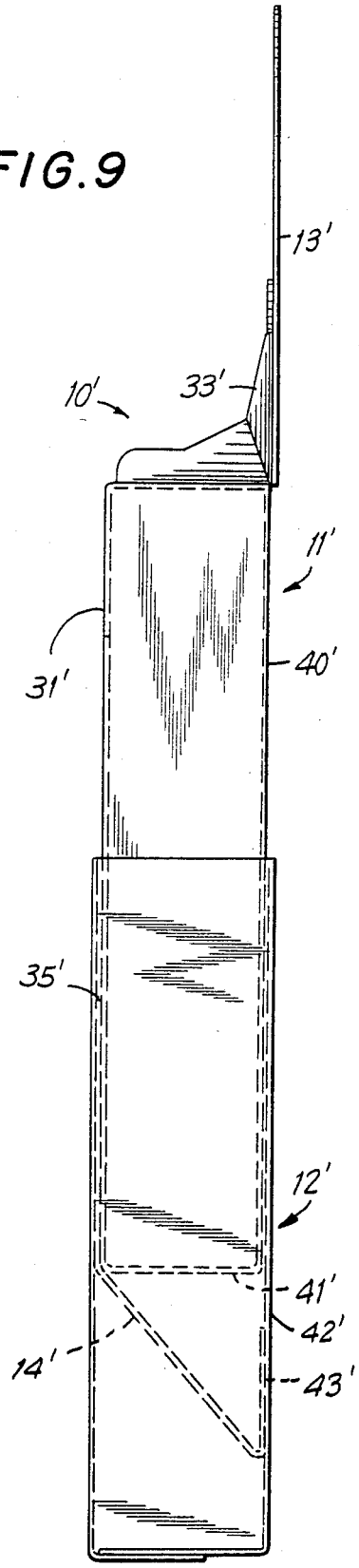
FIG. 9 is a side elevational view of the cigarette pack of FIGS. 7–8 in the open position.
Figure 7:
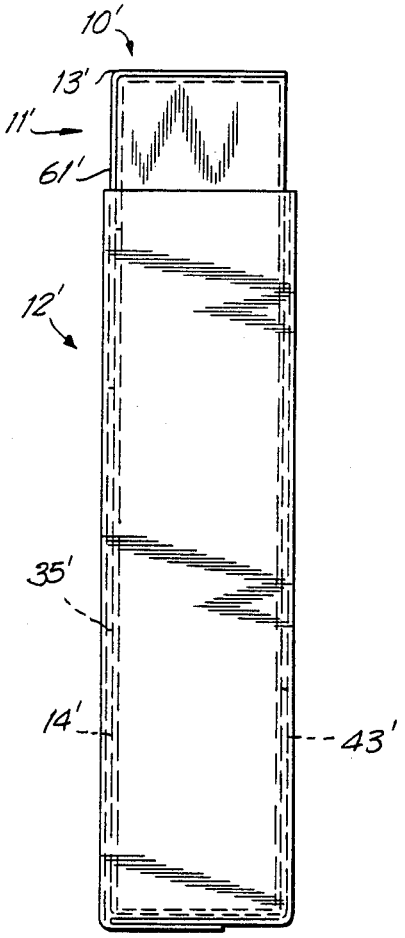
FIG. 7 is a side elevational view of another preferred embodiment of the cigarette pack of the invention in the closed position.
Figure 8:
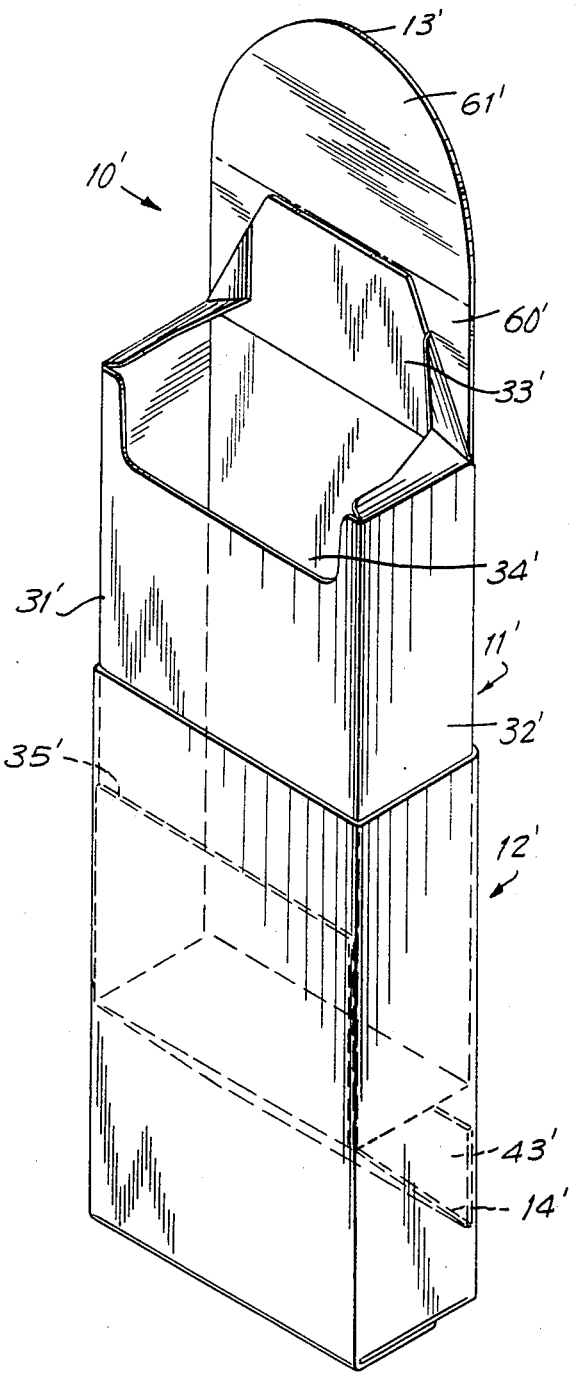
FIG. 8 is a front perspective view of the cigarette pack of FIG. 7 in the open position.

A second preferred embodiment of the cigarette pack of the present invention is shown in FIGS. 7–9. Cigarette pack 10' includes an inner sleeve member 11', an outer sleeve member 12', a tab member 13', and a retainer member 14', and when closed is similar in appearance to cigarette pack 10 as seen in FIG. 1.

Inner sleeve member 11' has a front wall 31' with cutout 34', a back wall 40', a bottom wall 41', a first side wall 32', and a second side wall, not shown. Sleeve member 11' also has a top flap 33'. Outer sleeve member 12' is identical to outer sleeve member 12.

Figure 11:
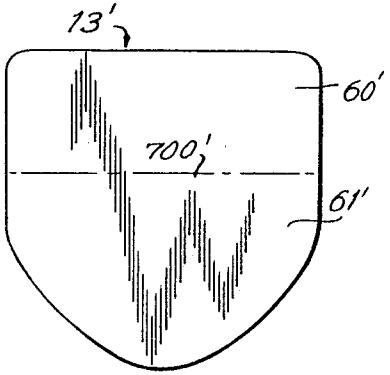
FIG. 11 is a plan view of a tab member for the cigarette pack of FIGS. 7–9.

Tab member 13' is preferably made of paperboard and the shape thereof is shown in FIG. 11. Tab member 13' is divided by score line 700' into top portion 60' and front portion 61'. Top portion 60' is adhered to flap 33' of inner sleeve member 11', as best seen in FIG. 8.

When cigarette pack 10' is closed, flap 33' is folded down along the top of inner sleeve member 11'. Tab member 13' is folded along score line 700' so that front portion 61' lies along front wall 31 of sleeve member 11', covering cutout 34'. Front portion 61' is positioned between sleeve members 11' and 12', as best seen in FIG. 7. In this way, cigarette pack 10' is closed against both the removal of cigarettes and the dropping out of loose tobacco, as in the first preferred embodiment.

Also as in the first preferred embodiment, retainer member 14' is provided to prevent sleeve member 11' from being completely withdrawn from sleeve member 12'. One end of retainer member 14' is adhered to the outside of front wall 31' of inner sleeve member 11' at 35'. The other end of retainer member 14' is adhered to the inside of back wall 42' of outer sleeve member 12' at 43', thereby limiting the withdrawal of sleeve member 11' from sleeve member 12', as shown in FIG. 9.

Figure 10:
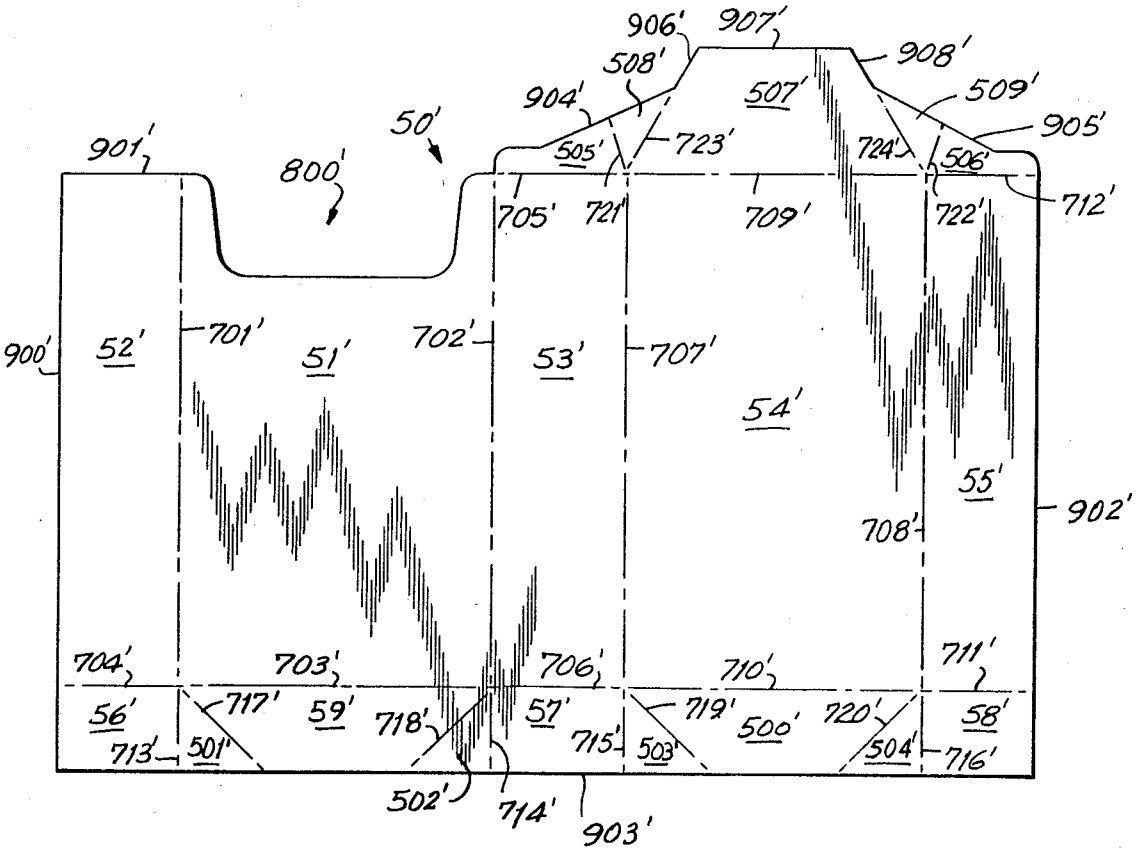
FIG. 10 is a plan view of an inner sleeve member blank for the cigarette pack of FIGS. 7–9.

A foil-paper laminate blank 50' from which inner sleeve member 11' is erected is shown in FIG. 10. Blank 50' has a front wall panel 51' defined by a pair of parallel long front-defining score lines 701', 702', a short front-defining score line 703' perpendicular to score lines 701', 702', and a cutout 800'. Inner side panel 52' is defined by score line 701', inner side-defining score line 704' perpendicular to score line 701', and edges 900', 901' of blank 50'. First outer side panel 53' is defined by score line 702', parallel first outer side-defining score lines 705', 706' perpendicular to score line 702', and first long back-defining score line 707'. Back wall panel 54' is defined by score line 707', second long back-defining score line 708' parallel to score line 707', and parallel short back-defining score lines 709', 710' perpendicular to score lines 707', 708'. Second outer side panel 55' is defined by score line 708', parallel second outer side-defining score lines 711', 712', and edge 902' of blank 50'. Inner closure tab 56' is defined by score line 704', inner closure tab-defining score line 713' perpendicular to score line 704', and edges 900', 903' of blank 50'. First outer closure tab 57' is defined by score line 706', parallel first outer closure tab-defining score lines 714', 715' perpendicular to score line 706', and edge 903' of blank 50'. Second outer closure tab 58' is defined by score line 711', second outer closure tab-defining score line 716' perpendicular to score line 711', and edges 902', 903' of blank 50'. Outer bottom panel 59' is defined by score line 703', opposed diagonal outer bottom-defining score lines 717', 718', and edge 903' of blank 50'. Inner bottom panel 500' is defined by score line 710', opposed diagonal inner bottom defining score lines 719', 720', and edge 903' of blank 50'. First outer bottom folding panel 501' is defined by score lines 713', 717' and edge 903' of blank 50'. Second outer bottom folding panel 502' is defined by score lines 714', 718' and edge 903' of blank 50'. First inner bottom folding panel 503' is defined by score lines 715', 719' and edge 903' of blank 50'. Second inner bottom folding panel 504' is defined by score lines 716', 720' and edge 903' of blank 50'. First top closure tab 505' is defined by score line 705', first top closure-defining score line 721', and edge 904' of blank 50'. Second top closure tab 506' is defined by score line 712', second top closure-defining score line 722', and edge 905' of blank 50'. Top flap panel 507' is defined by score line 709', opposed oblique flap-defining score lines 723', 724', and edges 906', 907', 908' of blank 50'. First top folding panel 508' is defined by score lines 721', 723' and edge 904' of blank 50'. Second top folding panel 509' is defined by score lines 722', 724' and edge 905' of blank 50'.

The cigarette pack described herein provides a reclosable container which prevents the dropping out of loose tobacco, and offers added protection to the cigarettes within it. It also has soft corners and collapses as its contents are smoked, taking up less room in a smoker's pocket or purse and providing an approximate visual indication of the number of cigarettes remaining therein. The pack can be overwrapped with cellophane in the conventional manner to keep the cigarettes fresh.

It will be apparent to those skilled in the art that the invention described herein can be practiced by other than the embodiments described above, which are presented for the purposes of illustration and not of limitation, and the present invention is limited only by the claims which follow.

What is claimed is:

1. A cigarette pack comprising:

an inner sleeve member, said inner sleeve member having a solid rectangular shape, and having a height substantially the length of a cigarette, a width approximately an integral multiple of the diameter of a cigarette, and a depth sufficient to accommodate a plurality of rows of cigarettes, said inner sleeve member further having a front wall and a back wall each defined by said height and said width, a bottom wall defined by said width and said depth, and first and second side walls each defined by said height and said depth, said front wall having a cutout portion at the top thereof forming an opening through which cigarettes may be withdrawn;

an outer sleeve member having front, back, and bottom walls and first and second side walls telescoped about said inner sleeve member, such that said inner sleeve member protrudes sufficiently from the top of said outer sleeve member for said inner sleeve member to be grasped;

a tab member having a top portion and a front portion; and a retaining member; wherein a portion of said tab member is adhered to a portion of said inner sleeve member, said front portion of said tab member being positioned between said inner and outer sleeve members covering said cutout portion when said inner sleeve member is fully retracted within said outer sleeve member, such that said cigarette pack is closed, and being free to move when said inner sleeve member is at least partially withdrawn from said outer sleeve member, such that said cigarette pack is open, said retaining member preventing said inner sleeve member from being completely withdrawn from said outer sleeve member.

2. The cigarette pack of claim 1 wherein said inner sleeve member comprises a foil-paper laminate, said tab member comprises paperboard and has a score line dividing said top portion from said front portion, and said other sleeve member comprises paper.

3. The cigarette pack of claim 1 wherein said retaining member comprises a paper web which is adhered at a first end thereof to the interior of said outer sleeve member and at a second end thereof to the exterior of said inner sleeve member.

4. The cigarette pack of claim 2 wherein said retaining member comprises a paper web which is adhered at a first end thereof to the interior of said outer sleeve member and at a second end thereof to the exterior of said inner sleeve member.

5. The cigarette pack of claim 4 wherein said tab member further comprises a rear portion, said rear portion of said tab member being adhered to said back wall of said inner sleeve member.

6. The cigarette pack of claim 5 wherein said top portion of said tab member is defined by said width and said depth, the widest portion of said front portion of said tab member is defined by said width, the widest portion of said rear portion is defined by said width and adjoins said top portion, the length of said rear portion is no greater than said height, and the breadth of said rear portion along substantially its entire length is less than said width.

7. The cigarette pack of claim 6 wherein said inner sleeve member is erected from a laminate blank comprising:

a front wall panel defined by a pair of parallel long front-defining score lines, a short front-defining score line perpendicular to said long front-defining score lines, and a cutout portion;

a first outer side panel connected to said front wall panel along one of said long front-defining score lines and further defined by a pair of parallel first outer side-defining score lines perpendicular to said long front-defining score lines;

a second outer side panel connected to the other of said long front-defining score lines, and further defined by a pair of parallel second outer side-defining score lines perpendicular to said long front-defining score lines and a first long back-defining score line parallel to said long front-defining score lines;

a back wall panel connected to said first outer side panel along said first long back-defining score line, and further defined by a second long back-defining score line parallel to said first long back-defining score line and a short back-defining score line perpendicular to said long back-defining score lines;

an inner side panel connected to said back wall panel along said second long back-defining score line, and further defined by an inner side-defining score line perpendicular to said long back-defining score lines;

a first outer closure tab connected to said first outer side panel along one of said first outer side-defining score lines, and further defined by a first outer closure tab-defining score line perpendicular to said first outer side-defining score line;

a second outer closure tab connected to said second outer side panel along one of said second outer side-defining score lines, and further defined by a pair of parallel second outer closure tab-defining score lines perpendicular to said second outer side-defining score lines;

an inner closure tab connected to said inner side panel along said inner side-defining score line and further defined by an inner closure tab-defining score line perpendicular to said inner side-defining score line;

an inner bottom panel connected to said back wall panel along said short back-defining score line and further defined by a pair of opposed diagonal inner bottom-defining score lines;

an outer bottom panel connected to said front wall panel along said short front-defining score line and further defined by a pair of opposed diagonal outer bottom-defining score lines;

a first outer bottom folding panel connected to said first outer closure tab along said first outer closure tab-defining score line and to said outer bottom panel along one of said opposed diagonal outer bottom-defining score lines;

a second outer bottom folding panel connected to said second outer closure tab along one of said second outer closure tab-defining score lines and to said outer bottom panel along the other of said opposed diagonal outer bottom-defining score lines;

a first inner bottom folding panel connected to said second outer closure tab along the other of said second outer closure tab-defining score lines and to said inner bottom panel along one of said opposed diagonal inner bottom-defining score lines;

a second inner bottom folding panel connected to said inner closure tab along said inner closure tab-defining score line and to said inner bottom panel along the other of said opposed diagonal inner bottom-defining score lines;

a first top closure tab connected to said first outer side panel along the other of said first outer side-defining score lines; and a second top closure tab connected to said second outer side panel along the other of said second outer side-defining score lines.

8. The cigarette pack of claim 7 wherein said laminate is a foil-paper laminate.

9. The cigarette pack of claim 4 wherein said inner sleeve member further comprises a top flap having said depth, said top portion of said tab member being adhered to said top flap.

10. The cigarette pack of claim 9 wherein said inner sleeve member is erected from a laminate blank comprising:

a front wall panel defined by a pair of parallel long front-defining score lines, a short front-defining score line perpendicular to said long front-defining score lines, and a cutout portion;

an inner side panel connected to said front wall panel along one of said long front-defining score lines and further defined by an inner side-defining score line perpendicular to said long front-defining score lines;

a first outer side panel connected to the other of said long front-defining score lines, and further defined by a pair of parallel first outer side-defining score lines perpendicular to said long front-defining score lines and a first long back-defining score line parallel to said long front-defining score lines;

a back wall panel connected to said first outer side panel along said first long back-defining score line, and further defined by a second long back-defining score line parallel to said first long back-defining score line and a pair of parallel short back-defining score lines perpendicular to said long back-defining score lines;

a second outer side panel connected to said back wall panel along said second long back-defining score line, and further defined by a pair of second outer side-defining score lines perpendicular to said long back-defining score lines;

an inner closure tab connected to said inner side panel along said inner side-defining score line, and further defined by an inner closure tab-defining score line perpendicular to said inner side-defining score line;

a first outer closure tab connected to said first outer side panel along one of said first outer side-defining score lines, and further defined by a pair of parallel first outer closure tab-defining score lines perpendicular to said first outer side-defining score lines;

a second outer closure tab connected to said second outer side panel along one of said second outer side-defining score lines and further defined by a second outer closure tab-defining score line perpendicular to said one of said second outer side-defining score lines;

an inner bottom panel connected to said back wall panel along one of said short back-defining score lines and further defined by a pair of opposed diagonal inner bottom-defining score lines;

an outer bottom panel connected to said front wall panel along said short front-defining score line and further defined by a pair of opposed diagonal outer bottom-defining score lines;

a first outer bottom folding panel connected to said inner closure tab along said inner closure tab-defining score line and to said outer bottom panel along one of said opposed diagonal outer bottom-defining score lines;

a second outer bottom folding panel connected to said first outer closure tab along one of said first outer closure tab-defining score lines and to said outer bottom panel along the other of said opposed diagonal outer bottom-defining score lines;

a first inner bottom folding panel connected to said first outer closure tab along the other of said first outer closure tab-defining score lines and to said inner bottom panel along one of said opposed diagonal inner bottom-defining score lines;

a second inner bottom folding panel connected to said second outer closure tab along said second outer closure tab-defining score line and to said inner bottom panel along the other of said opposed diagonal inner bottom-defining score lines;

a first top closure tab connected to said first outer side panel along the other of said first outer side-defining score lines and further defined by a first top closure-defining score line;

a second top closure tab connected to said second outer side panel along the other of said second outer side-defining score lines and further defined by a second top closure-defining score line;

a top flap panel connected to said back wall panel along the other of said short back-defining score lines and further defined by a pair of opposed oblique flap-defining score lines;

a first top folding panel connected to said first top closure tab along said first top closure-defining score line and to said top flap panel along one of said oblique flap-defining score lines; and a second top folding panel connected to said second top closure tab along said second top closure-defining score line and to said top flap panel along the other of said oblique flap-defining score lines.

11. The cigarette pack of claim 10 wherein said laminate is a foil-paper laminate.

* * * * *